US006557971B1

(12) United States Patent
Vega et al.

(10) Patent No.: US 6,557,971 B1
(45) Date of Patent: May 6, 2003

(54) METHOD FOR SERVICING AN INKJET PRINTHEAD

(75) Inventors: Ramon Vega, Sabadell (ES); Xavier Girones, Mora la Nova (ES); Xavier Bruch, Sant Cugat del Valles (ES); Antoni Murcia, San Diego, CA (US); Kenneth E Trueba, Philomath, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 136 days.

(21) Appl. No.: 09/644,394

(22) Filed: Aug. 22, 2000

(51) Int. Cl.[7] ..... B41J 2/165
(52) U.S. Cl. ..... 347/35
(58) Field of Search ..... 347/35, 14, 23, 347/19, 10, 29, 30, 32, 92, 9

(56) References Cited

U.S. PATENT DOCUMENTS 5,298,923 A * 3/1994 Tokunaga et al. ..... 347/23
5,428,380 A * 6/1995 Ebisawa ..... 347/35
5,734,399 A 3/1998 Weber et al. ..... 347/65
5,755,032 A 5/1998 Pan et al. ..... 29/890.1
6,007,188 A 12/1999 MacLeod et al. ..... 347/65
6,293,645 B1 * 9/2001 Kim ..... 347/723

* cited by examiner

*Primary Examiner*—Shih-wen Hsieh

(57) ABSTRACT

A method for servicing an inkjet printhead effects recovery against a particular printhead failure mode via implementation of a printhead servicing routine including, but not limited to, a bubble recovery routine, a contaminant purging routine, and/or a (standard) printhead servicing routine. In a preferred embodiment, the method for servicing an inkjet printhead takes into consideration nozzle health data, diagnostics, or the like. In a preferred embodiment, a bitmap or mask is employed to control firing of the nozzles during the servicing of the printhead. In a preferred embodiment, the servicing method includes the step of: firing the printing nozzles in a manner tending to force contaminants at the printing nozzles toward one end of the printhead. In another preferred embodiment, the servicing method includes the steps of: providing an inkjet printhead with larger-sized sewage nozzles at its edges; firing the printhead nozzles in a manner which forces contaminants to the edges; and firing the sewage nozzles to expel the contaminants.

15 Claims, 5 Drawing Sheets

METHOD FOR SERVICING AN INKJET PRINTHEAD

BACKGROUND OF THE INVENTION

1. Field of Invention

The present invention relates generally to a method for servicing an inkjet printhead and, more specifically, to a method for recovering against specific failure modes in inkjet devices.

2. Description of the Related Art

Thermal inkjet technology uses heat energy to vaporize a thin layer of ink to form a bubble that expels a small drop of ink through an orifice or nozzle. As the ink leaves the nozzle head, it creates a vacuum that pulls in fresh ink. This process is repeated thousands of times per second. Each nozzle of a typical inkjet printhead is backed by a heater or resistor which heats under control of electronic circuitry. Piezoelectric inkjet printing, another form of drop-on-demand inkjet printing, uses a mechanical mechanism to eject ink.

Thermal inkjet nozzles experience a variety of different failure modes. One of the most typical failure modes is caused by air bubbles which are trapped in the firing chamber. These bubbles can have several sources: air ingested during pen insertion due to a "hard" insertion (pen shock against carriage), very low negative pressure when a pen is running with an almost empty ink supply, and particles blocking an ink entrance and inducing an air bubble.

One solution to this problem is to simply allow the pen to rest long enough for the air bubble to redisolve into the ink. However, such a solution is not always practical or desirable—particularly when end users expect some form of intervention mechanism (user invoked or otherwise) for effecting printhead recovery. Although a printer can be equipped with a positive or negative pressure prime, this will not provide printhead recover in all instances. Also, spitting at one frequency or simply wiping a nozzle is usually not an efficient way to recover from chamber bubbles.

A recent trend in inkjet devices is to reduce the size of the printhead nozzles in order to reduce the volume of the drops fired, thereby increasing perceived image quality. An unfortunate byproduct is this is that smaller sized contaminants which are more difficult to filter can end up leading to malfunctioning nozzles.

Another trend in inkjet devices is to increase the number of nozzles in one printhead to improve print times. However, more nozzles can result in a larger volume of printhead that needs to be free of particles.

A prior approach to solving the problem of internal contaminants is to generate a set of barriers that block the entrance of particles and contaminants to the nozzle chamber but still allow ink to flow through. This is commonly known as particle tolerant architecture (PTA). Usually, the barrier design provides two entrances to each nozzle chamber so that if one is completely blocked, ink can still flow through the other. Examples of particle tolerant architectures can be found in U.S. Pat. No. 5,734,399 to Weber et al., U.S. Pat. No. 5,755,032 to Pan et al., and U.S. Pat. No. 6,007,188 to MacLeod et al.

Although PTA designs are relatively easy to implement and manufacture, they are not without their defects. For example, blockage of one of the entrances usually results in a pressure drop which, in turn, leads to a weak or misdirected nozzle. Also, in particle tolerant architectures, internal contaminants tend to get stuck in the entrances and are difficult to "drag out".

In designs without PTA, contaminants do not get stuck as easily but they move freely from one nozzle to the other pulled by the negative pressure generated in an adjacent nozzle chamber entrance when that nozzle fires. The end effect is that there are malfunctioning nozzles that "move" along the pen.

Another undesirable effect of internal contaminants is that they can lead to "puddling". When a particle moves in front of a channel, the nozzle is starved of ink and a chamber bubble forms—effectively shutting down the nozzle. As a result, there is not enough ink available to eject the drop at its normal firing velocity but enough to dump ink out of the nozzle onto the surface of the pen. The external puddle usually ends up growing and knocking out adjacent nozzles which then also contribute to the puddle. This leads to severe banding with some ink drops falling on the media, the puddle being so large that gravity wins against surface tension.

Given the variety of potential failure modes in the printhead operating environment, it would be helpful to have a method for recovering against specific failure modes. In particular, there is a need for a bubble recovery routine which is more efficient and/or effective than conventional servicing spitting. A contaminant purging routine is also needed for non-PTA designs. It would also be helpful to be able to effect a printhead servicing routine in consideration of nozzle health data, diagnostics, or the like to more efficiently and/or effectively address a detected malfunction or condition.

SUMMARY OF THE INVENTION

According to the present invention, a method for servicing an inkjet printhead is provided. In a preferred embodiment, the method for servicing an inkjet printhead effects recovery against a particular printhead failure mode via implementation of a printhead servicing routine including, but not limited to, a bubble recovery routine, a contaminant purging routine, and/or a (standard) printhead servicing routine. In a preferred embodiment, the method for servicing an inkjet printhead takes into consideration nozzle health data, diagnostics, or the like. In a preferred embodiment, a bitmap or mask is employed to control firing of the nozzles during the servicing of the printhead. It is expected that bitmapped or masked spitting will facilitate a wide variety of treatments for printheads in order to restore nozzle performance and combat several failure modes from which conventional spitting does not provide recovery.

A method for servicing an inkjet printhead in accordance with one embodiment of the present invention includes the steps of: providing a printhead for an inkjet printer, the printhead including a plurality of printing nozzles; and firing the printing nozzles in a manner tending to force contaminants at the printing nozzles toward one end of the printhead. In a preferred embodiment, the contaminants are moved by firing consecutive printing nozzles. In a preferred embodiment, the method further includes the step of employing a bitmap to control the firing of the printing nozzles. In a preferred embodiment, the method further includes the step of generating the bitmap to effect recovery against a specific failure mode. In a preferred embodiment, the method further includes the step of generating the bitmap depending upon which of the printing nozzles needs to be serviced. In a preferred embodiment, the method further includes the step of dynamically (or otherwise) generating the bitmap depending upon nozzle health data.

A method for servicing an inkjet printhead in accordance with another embodiment of the present invention includes the steps of: providing a printhead for an inkjet printer, the printhead including a plurality of printing nozzles; selecting a group of the printing nozzles; and firing the group of printing nozzles while varying a firing frequency at which the nozzles are fired. In a preferred embodiment, the firing frequency is selected such that it tends to resonate bubbles which are typically trapped in the printing nozzles. In a preferred embodiment, the firing frequency starts at a low frequency and ends at a high frequency. In a preferred embodiment, the group of printing nozzles includes a malfunctioning nozzle. In a preferred embodiment, the method further includes the step of employing a bitmap or mask to control the firing of the group of printing nozzles.

A method for servicing an inkjet printhead in accordance with another embodiment of the present invention includes the steps of: providing a printhead for an inkjet printer, the printhead including a plurality of printing nozzles and at least one sewage nozzle positioned at an edge of the printhead, the at least one sewage nozzle being larger is size than the printing nozzles; firing the printing nozzles in a manner which creates a negative pressure associated with the printhead, the negative pressure tending to force contaminants at the printing nozzles toward the edge of the printhead; and firing the at least one sewage nozzle to expel the contaminants into a spittoon of the inkjet printer. The sewage nozzles can be used during a servicing routine so the pen can be "flushed" at a convenient (i.e., lower) frequency. In a preferred embodiment, the at least one sewage nozzle comprises sewage nozzles positioned at opposite ends of the printhead. In a preferred embodiment, the printing nozzles are fired in a staggered firing order. In a preferred embodiment, the printing nozzles are fired in a sequential firing order. In a preferred embodiment, the method further includes the step of employing a wiper to wick ink out of the sewage nozzle and then wipe over the printing nozzles, thereby making the wiping process more effective.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

Figure 1:
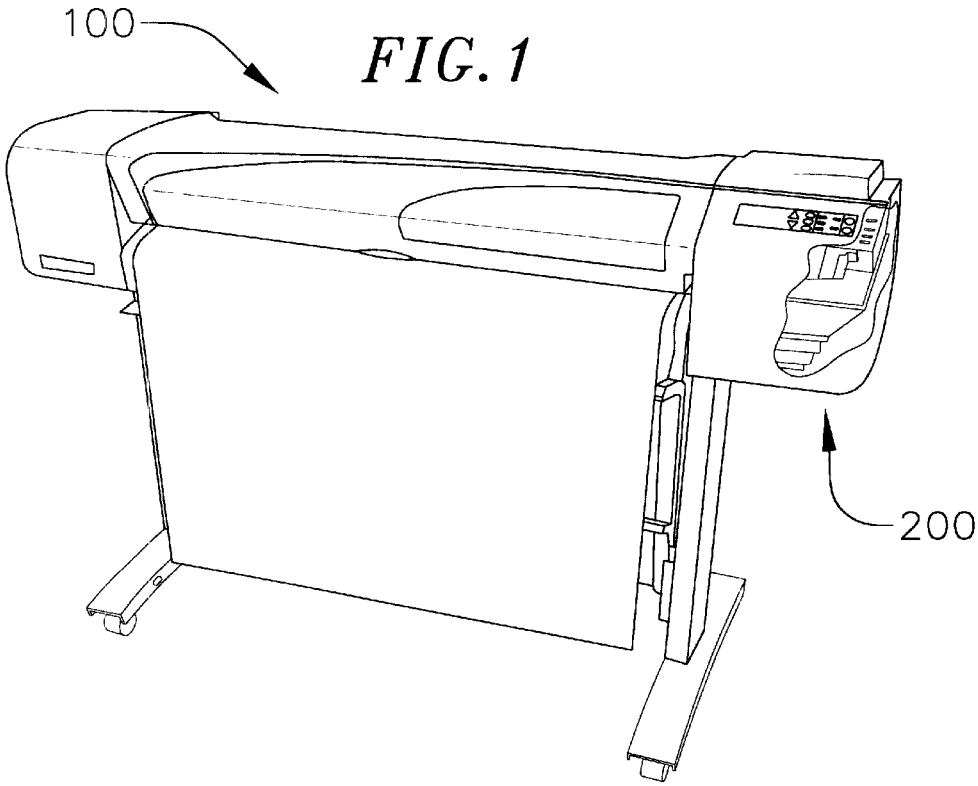
FIG. 1 is a perspective view of a printer configured to employ the principles of the present invention.

FIG. 1 shows a printer 100 configured to employ the principles of the present invention. By way of example, the printer 100 comprises a large-format thermal inkjet printer. It should be appreciated, however, that the principles of the present invention are also applicable to other types of inkjet printers such as piezoelectric and electrostatic inkjet printers.

In the illustrated exemplary preferred printer 100, ink cartridges reside inside an ink supply station 200 which is positioned on the right side of the printer 100. The illustrated exemplary preferred printer 100 includes four ink cartridges. The ink supply station 200 is configured to accommodate, for example, 69 cc capacity ink cartridges (for all colors).

Figure 2:
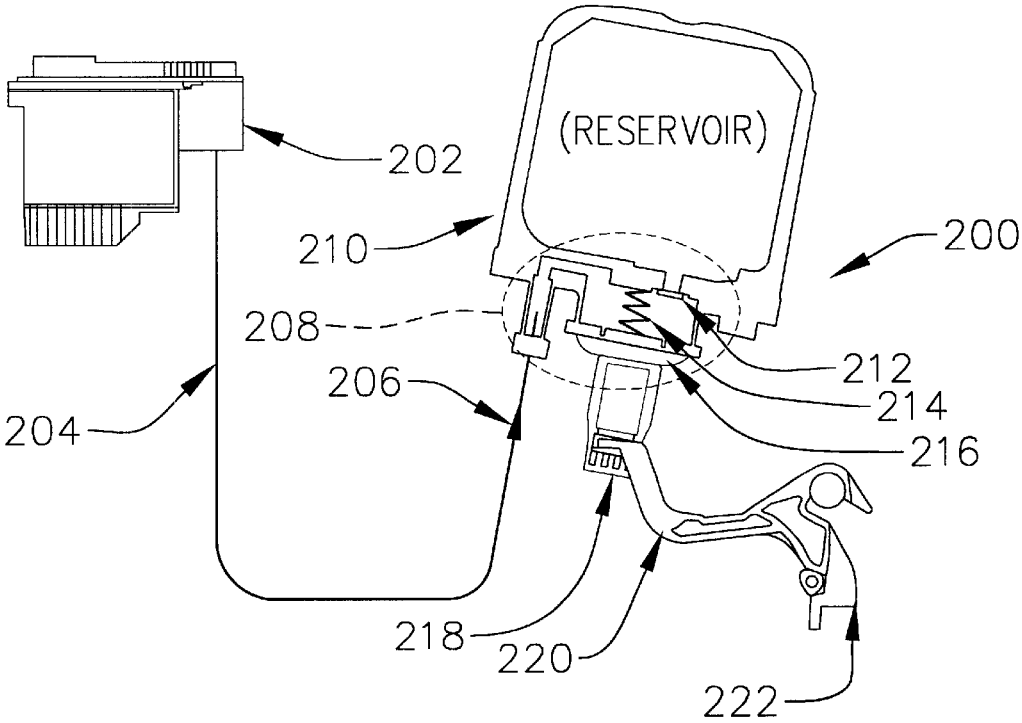
FIG. 2 is a partial cross-sectional diagram of an exemplary preferred embodiment of an ink supply station according to the present invention.

FIG. 2 illustrates an exemplary preferred embodiment of an ink supply station 200 of the printer 100. The ink supply station 200 and a tubes assembly (not shown) provide an ink delivery system for the printer 100. Generally, the ink delivery system functions to deliver ink from the ink cartridges of the printer 100 to the printheads of the printer 100. In an exemplary preferred embodiment, the ink delivery system is configured to deliver ink from off-axis ink cartridges via permanently connected tubes to high throughput printheads. It should be appreciated, however, that other ink delivery system configurations can be employed.

The illustrated exemplary preferred ink supply station 200 includes a pen 202, a tube 204, a needle 206, a pump 208, an ink supply 210, a lifter 218, and a rocker 220 configured as shown. An exemplary preferred pump 208 is a "bongo pump" and includes a flapper 212, a refill spring 214, and an elastomer bongo 216 configured as shown. Other mechanisms for pumping ink from the reservoir 210 and pump actuation mechanisms different from the illustrated lifter/rocker mechanism can also be employed.

Operationally, the ink supply station 200 provides pressure to pump ink from the ink cartridges to the printheads and, preferably, includes a mechanism for each ink cartridge. The spring 214 pulls from the rocker 220 which, in turn, pushes the lifter 218 which pressurizes the bongo. The printer 100 includes a motor-driven camshaft (not shown) which moves the four lifters 218. The illustrated exemplary preferred ink supply station 200 includes an edge 222 for optical triggering. An exemplary preferred ink supply station 200 also includes sensors (not shown) which detect when the pump chamber is empty and needs to be refilled (by pushing down on the lifters).

Figure 3:
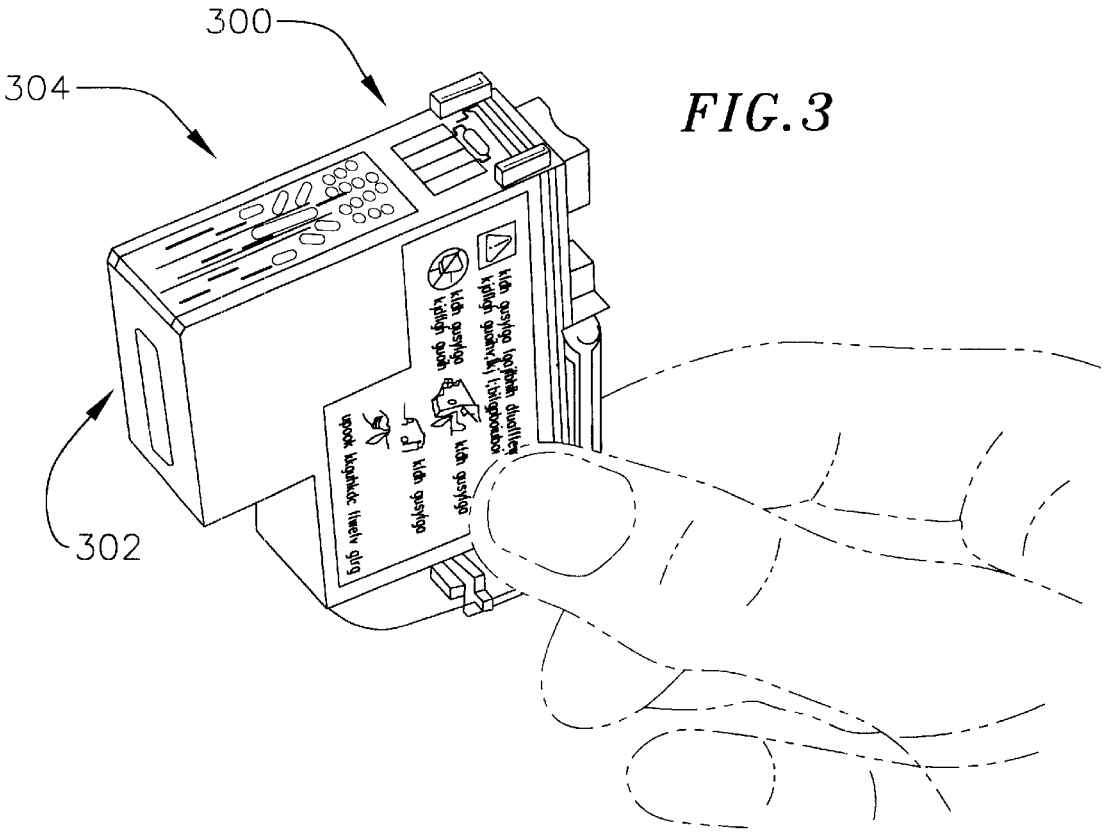
FIG. 3 is a perspective view of an exemplary preferred embodiment of a printhead according to the present invention.

Referring to FIG. 3, an exemplary preferred printhead 300 is illustrated. The printhead 300 includes a nozzle plate 302 (formed with a plurality of nozzles) and electrical circuitry 304. In a preferred embodiment, the electrical circuitry 304 includes and/or employs a bitmap, mask or the like to control the firing of the nozzles.

Figure 4:
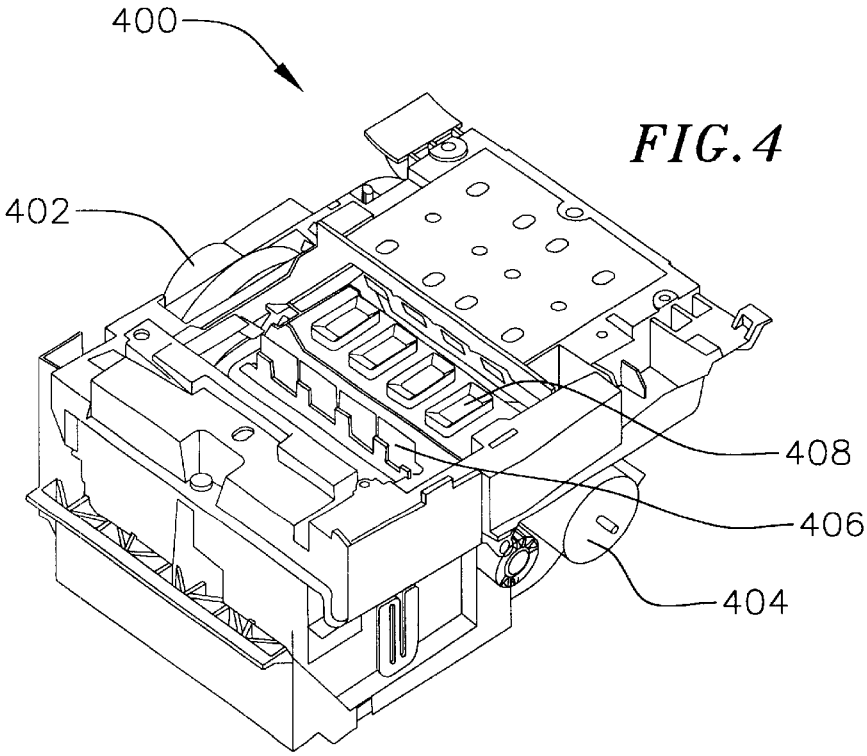
FIG. 4 is a perspective view of an exemplary preferred embodiment of a service station according to the present invention.

Referring to FIG. 4, an exemplary preferred service station 400 is illustrated. The illustrated exemplary service station 400 includes a spittoon 402, a service station motor 404, a wiping system 406, and a capping system 408 configured as shown. The functions of the service station 400 include: wiping of the nozzle plate surface of the printheads; applying dissolvent on the nozzle plate surface of the printheads; and capping the printheads when they are not printing. The printhead 300 is also controlled to perform a spitting action in order to recover or refresh the firing nozzle performance. The spittoon 402 retains the ink to reduce the risk of ink leakage. A secondary spittoon (not shown), which performs the same routine, is located on the left side of the printer 100. The wiping system 406 is employed to remove ink residue and external debris from the printhead 300 to maintain good drop ejection and nozzle performance. Dissolvent and lubricant (e.g., PolyEthileneGlycol 400) is applied to the nozzle plate (also by means of wiping) to help dissolve ink spread on the nozzle plate and lubricate the wiper as it scrubs the nozzle plate.

Figure 5:
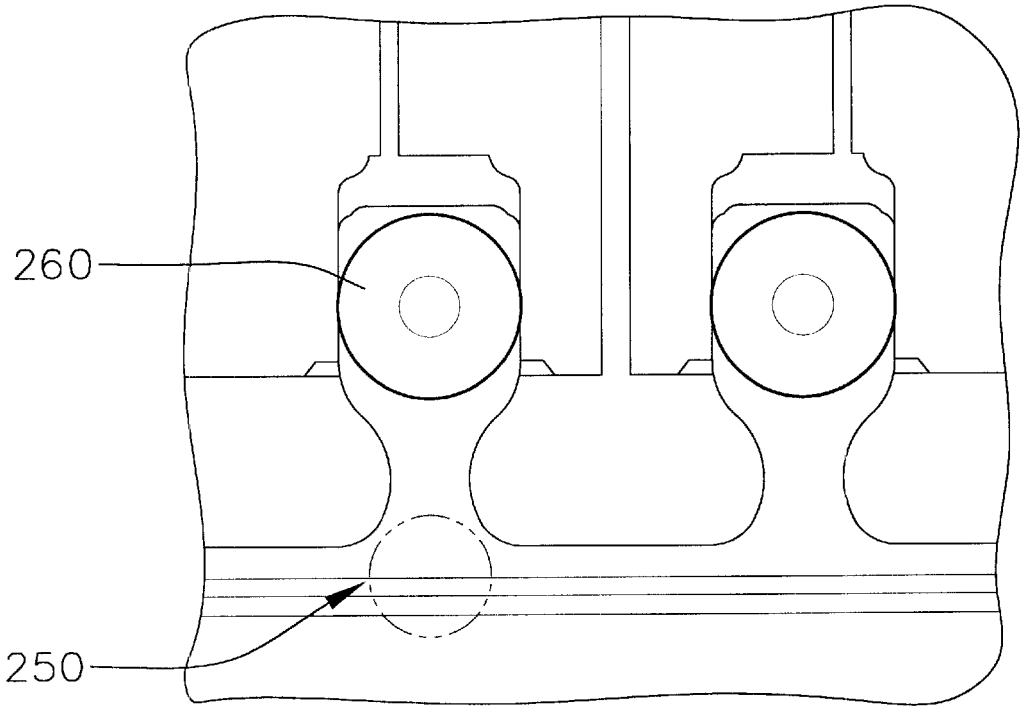
FIG. 5 is a cross-sectional view of a printhead showing a contaminant choking off a nozzle resulting in a bubble in the firing chamber.
Figure 6:
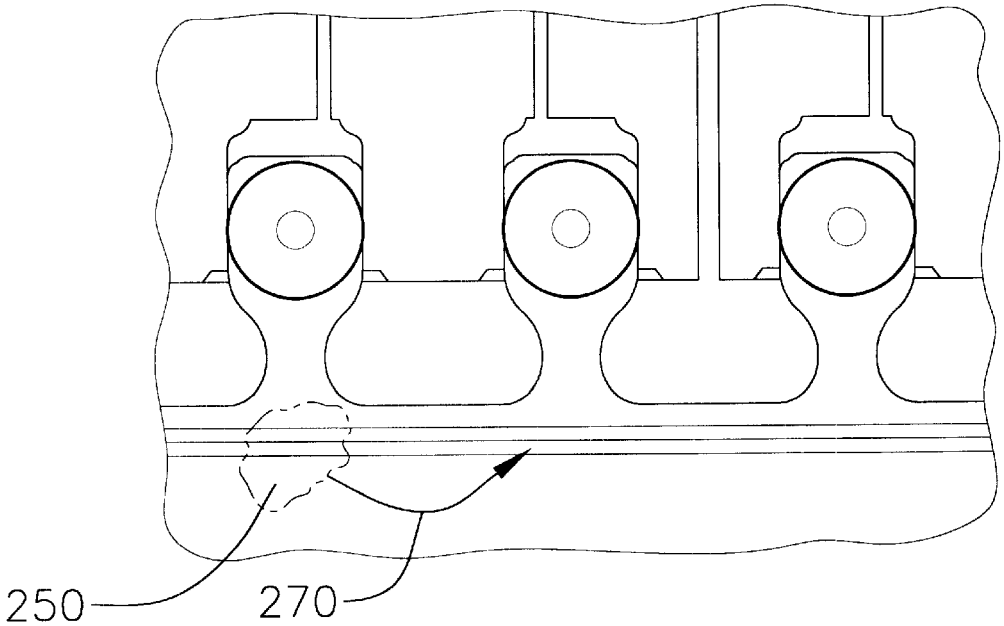
FIG. 6 is a cross-sectional view of a printhead showing movement of a contaminant from one nozzle to an adjacent nozzle.

In FIG. 5, a cross-sectional view of a printhead shows a contaminant 250 obstructing a nozzle 260 resulting in a bubble in the firing chamber. In FIG. 6, the internal contaminant 250 is shown making its way (as indicated by arrow 270) to the upper nozzles of the pen. A method for servicing an inkjet printhead according to the present invention is described below.

Figure 10:
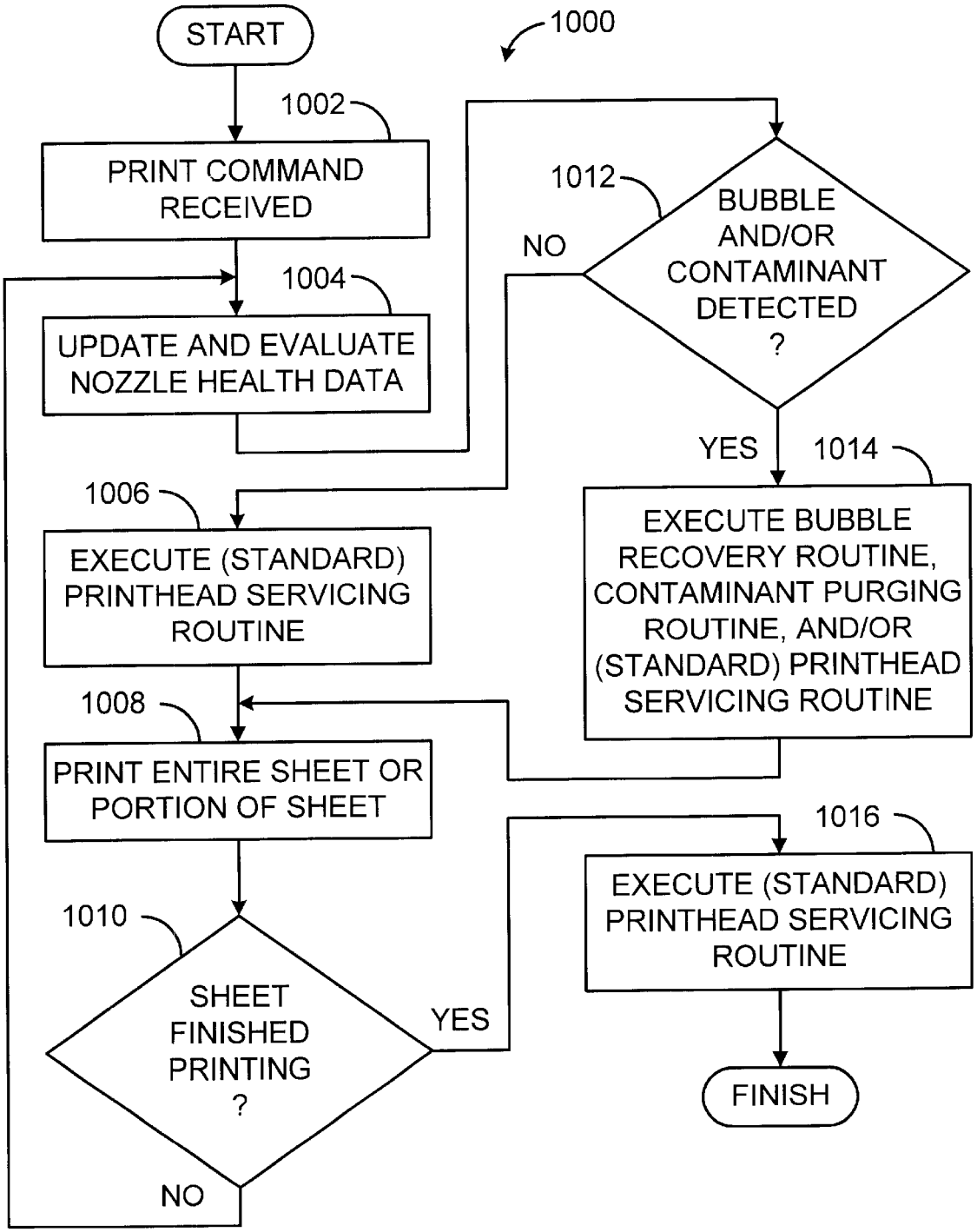
FIG. 10 is a flowchart illustrating the major steps of an exemplary preferred method for servicing an inkjet printhead according to the present invention.

In FIG. 10, an exemplary preferred method 1000 for servicing an inkjet printhead is shown in the form of a flowchart. After a print command is received at stop 1002, nozzle health data, diagnostics, or the like (e.g., provided by thermistors on the printhead after each print) are updated and evaluated at step 1004. If no bubble or contaminant is detected at 1012, a (standard) printhead servicing routine is performed at step 1006 before printing is started or restarted at step 1008. However, if a bubble and/or contaminant is detected at 1012, a bubble recovery routine, a contaminant purging routine, and/or a (standard) printhead servicing routine is/are performed at step 1014 before printing is started or restarted at step 1008. Once it is determined at step 1010 that an entire sheet is finished printing, a (standard) printhead servicing routine is preferably performed at step 1016. Exemplary preferred bubble recovery and contaminant purging routines according to the present invention are described below in greater detail.

It has been observed that nozzle health data, diagnostics, or the like vary depending upon the nature of particular failure modes, i.e., air bubbles and the various types of contaminants in the printhead operating environment tend to behave differently. The present invention exploits these observations to employ a recovery routine which is suited for a particular printhead failure mode. The present invention also provides a method for implementing different types of recovery routines depending upon nozzle health data, diagnostics, or the like.

In an exemplary preferred embodiment of the present invention, a diagnostic of nozzle health is regularly provided, e.g., after each print. According to the present invention, different bitmaps or masks are employed to control the firing of the nozzles depending upon the nozzle health data, diagnostics, or the like. In a preferred embodiment, bitmaps are dynamically generated by the printer 100 "on-the-fly" (e.g., while the printer carriage is still moving) depending upon current nozzle health data. By way of example, if it has been determined that an internal contaminant is positioned around nozzle number 120, then a special bitmap is generated which will effect nozzle spitting around this particular nozzle (e.g., from nozzle number 100 to nozzle number 140), but does not spit the rest of the nozzles on the printhead. Thus, the present invention provides for great variety and flexibility in the treatment of printheads in order to restore nozzle performance and combat the various different printhead failure modes.

Figure 9:
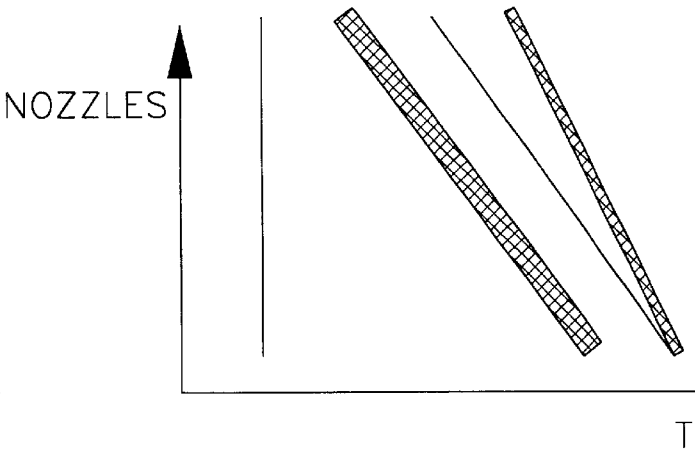
FIG. 9 is a plot of printhead bitmapped spitting (nozzles versus time) according to an exemplary preferred embodiment of the present invention.

An exemplary preferred contaminant purging routine according to the present invention generally involves firing consecutive nozzles to move potential contaminants to one end of the printhead (end of ink channels). Firing of the nozzles to "sweep" contaminants is preferably, but not necessarily, controlled by a bitmap. FIG. 9 provides an example of how a bitmap is constructed in order to effect a desired firing of nozzles along the printhead over time for a contaminant purging routine. Information pertaining, to the nozzles and the number of drops to be fired is contained in the bitmap. It should be appreciated that many different bitmaps can be constructed to accommodate particular detected conditions, failure modes, etc.—thus providing great flexibility.

Figure 8:
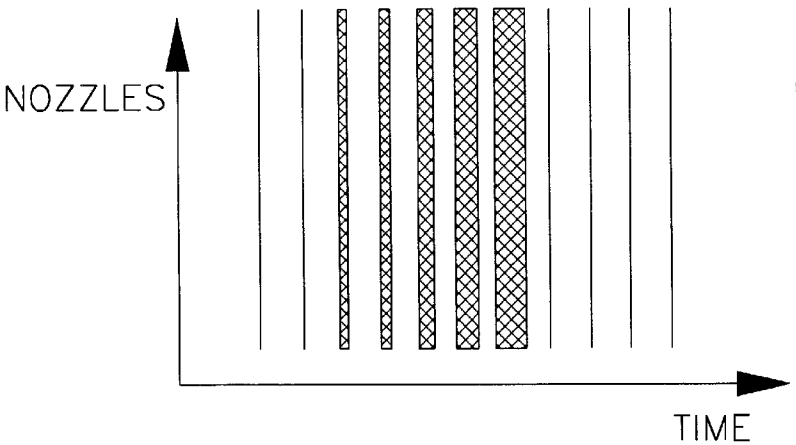
FIG. 8 is a plot of printhead masked spitting (nozzles versus time) according to an exemplary preferred embodiment of the present invention.

An exemplary preferred bubble recovery routine according to the present invention generally involves firing a nozzle or group of nozzles while varying a firing frequency at which the nozzle(s) are fired. In a preferred embodiment, the nozzle(s) to be fired is(are) determined depending upon nozzle health data, diagnostics, or the like. FIG. 8 provides an example of how a mask (or bitmap) is constructed in order to effect a desired firing of nozzles along the printhead over time for a bubble recovery routine. For example: 100 drops are fired from all of the nozzles at 500 Hz; 100 drops are fired from all of the nozzles at 1 kHz; etc. In a preferred embodiment, n drops are spit from a malfunctioning nozzle starting from a low frequency and ending at a high frequency to generate vibrations of different frequencies which help push bubbles back to the ink channel. By varying or scanning the firing frequency (e.g., from 200 Hz to 36 kHz), resonances are created which effect nozzle recovery from bubbles. In a preferred embodiment, the printer 100 is configured to compose bitmaps by employing a tiling technique.

Figure 7:
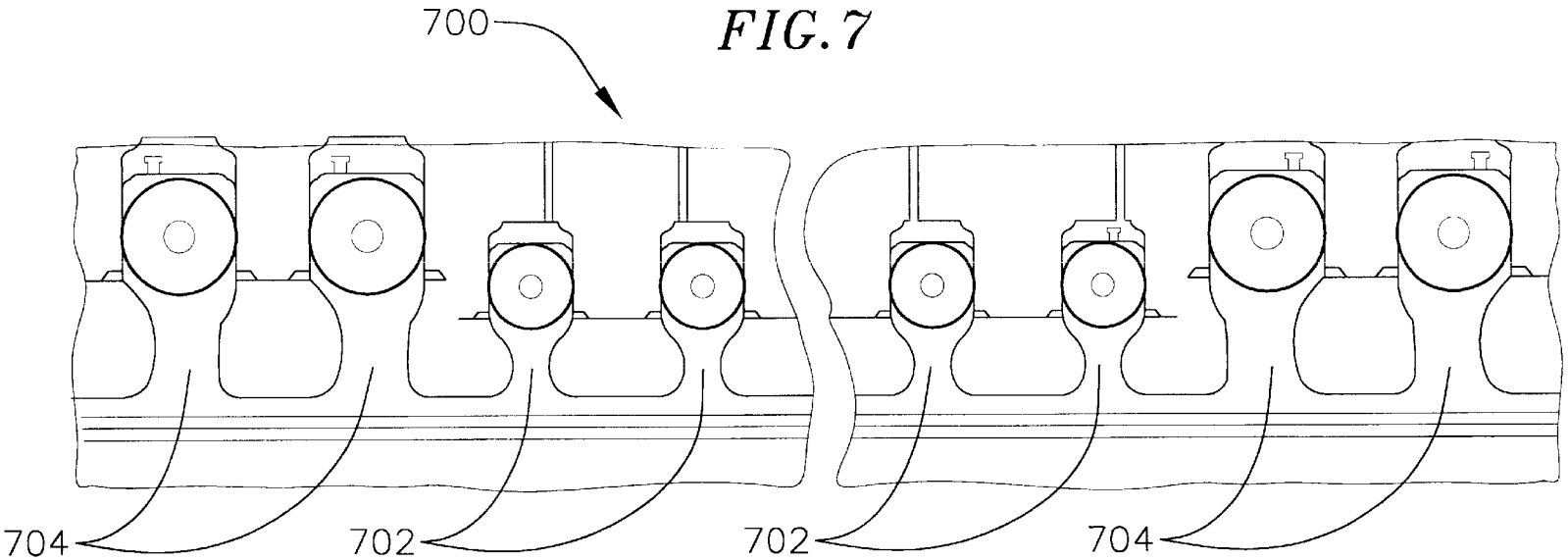
FIG. 7 is a cross-sectional view of an exemplary preferred embodiment of a printhead according to the present invention, the printhead including a plurality of printing nozzles and two larger-sized sewage nozzles at each end of the printhead.

Another exemplary preferred contaminant purging routine according to the present invention generally involves providing larger-sized nozzles at the ends of the printhead. These extra "sewage" nozzles are sufficiently large to allow small particles and internal contaminants to be expelled through flushing (spitting) at a convenient frequency such as 200 Hz. In a preferred embodiment, sewage nozzles are positioned at opposite ends of the printhead. For example, FIG. 7 shows an exemplary preferred printhead 700 according to the present invention. The illustrated printhead 700 includes a plurality of printing nozzles 702 (e.g., nine) and two sewage nozzles 704 at each end of the printhead 700.

Internal contaminants can be moved toward the edges in a variety of ways. One way is to take advantage of the staggered firing order of the nozzles, i.e., not all of the nozzles are fired at the same time, but instead are delayed a few nanoseconds to allow for the neighbor nozzle to refill properly. For example: sweeping from the top to the bottom of the printhead, firing nozzle numbers 1, 21, 41, . . . and then nozzle numbers 2, 22, 42, . . . , etc. Another way is to fire the nozzles sequentially, for example, starting with a group of nozzles at one end of the printhead 700 and ending at another group of nozzles at the other end of the printhead 700. In doing so, a negative pulse is generated which moves from one end of the printhead 700 to the other, dragging the particles and contaminants that are in its way.

One of the main advantages of this method of purging contaminants is that it avoids particle tolerant architecture that imposes design restrictions, especially when designing fast pens (>18 kHz firing frequency). It also provides a method for eventually getting rid of a contaminant while a PTA design does not. Finally, it simplifies the every tightening control of contaminants and pre-cleaning processes required in printhead manufacturing.

The larger-sized nozzles 704 at the end of the pen have an extra advantage: they are the first ones that touch the wiper in a wiping sequence. With the round shape of a typical wiper tip, the wiper will wick ink out of these larger-sized nozzles 704, pre-wetting the tip of the wiper and making the wiping process more effective when touching the rest of the nozzles 702. Thus, in a preferred embodiment, the method for servicing an inkjet printhead further includes the step of employing a wiper to wick ink out of the sewage nozzle(s) 704 and then wipe over the printing nozzles 702, thereby making the wiping process more effective.

Although the present invention has been described in terms of the preferred embodiment above, numerous modifications and/or additions to the above-described preferred embodiment would be readily apparent to one skilled in the art. It is intended that the scope of the present invention extends to all such modifications and/or additions.

We claim:

1. A method for servicing an inkjet printhead, the method comprising the steps of:

providing a printhead for an inkjet printer, the printhead including a plurality of printing nozzles arranged on a nozzle plate in an array; and firing the printing nozzles in a manner tending to force contaminants at the printing nozzles toward one end of the nozzle plate along the direction of the array of the printhead.

2. The method for servicing an inkjet printhead of claim 1, wherein the firing of the printing nozzles comprises firing consecutive printing nozzles.

3. The method for servicing an inkjet printhead of claim 1, further comprising the step of:

employing a bitmap to control the firing of the printing nozzles.

4. The method for servicing an inkjet printhead of claim 3, further comprising the step of:

generating the bitmap to effect recovery against a specific failure mode.

5. The method for servicing an inkjet printhead of claim 3, further comprising the step of:

generating the bitmap depending upon which of the printing nozzles needs to be serviced.

6. The method for servicing an inkjet printhead of claim 3, further comprising the step of:

generating the bitmap depending upon nozzle health data.

7. The method for servicing an inkjet printhead of claim 3, further comprising the step of:

employing a tiling technique to compose the bitmap.

8. The method for servicing an inkjet printhead of claim 1, wherein the firing of the printing nozzles comprises firing the printing nozzles as the printing nozzles are held stationary over a spittoon of the inkjet printer.

9. The method for servicing an inkjet printhead of claim 1, wherein the firing of the printing nozzles comprises firing the printing nozzles as the printing nozzles are swept over a spittoon of the inkjet printer.

10. The method for servicing an inkjet printhead of claim 1, wherein the inkjet printer is a thermal inkjet printer.

11. A method for servicing an inkjet printhead, the method comprising the steps of:

providing a printhead for an inkjet printer, the printhead including a plurality of printing nozzles and at least one sewage nozzle positioned at an edge of the printhead, the at least one sewage nozzle being larger is size than the printing nozzles;

firing the printing nozzles in a manner which creates a negative pressure associated with the printhead, the negative pressure tending to force contaminants at the printing nozzles toward the edge of the printhead; and firing the at least one sewage nozzle to expel the contaminants into a spittoon of the inkjet printer.

12. The method for servicing an inkjet printhead of claim 11, wherein the at least one sewage nozzle comprises sewage nozzles positioned at opposite ends of the printhead.

13. The method for servicing an inkjet printhead of claim 11, wherein the printing nozzles are fired in a staggered firing order.

14. The method for servicing an inkjet printhead of claim 11, wherein the printing nozzles are fired in a sequential firing order.

15. The method for servicing an inkjet printhead of claim 11, further comprising the step of:

employing a wiper to wick ink out of the sewage nozzle and then wipe over the printing nozzles.

* * * * *